US009340968B2

(12) United States Patent
Hohmann, Jr. et al.

(10) Patent No.: US 9,340,968 B2
(45) **Date of Patent: *May 17, 2016**

(54) ANCHORING SYSTEM HAVING HIGH-STRENGTH RIBBON LOOP ANCHOR

(71) Applicant: Columbia Insurance Company, Omaha, NE (US)

(72) Inventors: Ronald P. Hohmann, Jr., Hauppauge, NY (US); Ronald P. Hohmann, Hauppauge, NY (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/537,366

(22) Filed: Nov. 10, 2014

(65) Prior Publication Data

US 2015/0059280 A1 Mar. 5, 2015

Related U.S. Application Data

(62) Division of application No. 13/727,290, filed on Dec. 26, 2012, now Pat. No. 8,881,488.

(51) Int. Cl.

| | |
|---|---|
| ***E04B 1/41*** | (2006.01) |
| ***E04B 1/04*** | (2006.01) |
| ***E04B 2/46*** | (2006.01) |

(52) U.S. Cl.

CPC ..... *E04B 1/4185* (2013.01); *E04B 1/046* (2013.01); *E04B 2/46* (2013.01); *E04B 2001/4192* (2013.01)

(58) Field of Classification Search

CPC ..... E04B 1/4178; E04B 1/4185; E04B 2/46; E04B 1/046; E04B 2001/4192

See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,014,157 | A | 1/1912 | Lewen |
| 1,170,419 | A | 2/1916 | Coon et al. |

(Continued)

FOREIGN PATENT DOCUMENTS

| | | |
|---|---|---|
| CH | 279209 | 3/1952 |
| EP | 0 199 595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Elizabeth A Quast
(74) *Attorney, Agent, or Firm* — Senniger Powers LLP

(57) ABSTRACT

A high-strength ribbon loop anchor and cavity wall anchoring system employing the same is disclosed. The ribbon loop anchor is a wire formative construct that is cold-worked with the resultant body having substantially semicircular edges and flat surfaces therebetween. The edges are aligned to receive compressive forces transmitted from the facing wall. The ribbon loops hereof, when part of the anchoring system, interengage with the veneer tie and are dimensioned to preclude significant movement lateral with or normal to the inner wythe.

14 Claims, 8 Drawing Sheets

(56) References Cited

U.S. PATENT DOCUMENTS

| | | | |
|---|---|---|---|
| RE15,979 | E | 1/1925 | Schaefer et al. |
| 1,794,684 | A | 3/1931 | Handel |
| 1,936,223 | A | 11/1933 | Awbrey |
| 1,988,124 | A | 1/1935 | Johnson |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,343,764 | A | 3/1944 | Fuller |
| 2,403,566 | A | 7/1946 | Thorp et al. |
| 2,413,772 | A | 1/1947 | Morehouse |
| 2,605,867 | A | 8/1952 | Goodwin |
| 2,780,936 | A | 2/1957 | Hillberg |
| 2,898,758 | A | 8/1959 | Henrickson |
| 2,909,054 | A | 10/1959 | Phillips |
| 2,929,238 | A | 3/1960 | Kaye |
| 2,966,705 | A | 1/1961 | Massey |
| 2,999,571 | A | 9/1961 | Huber |
| 3,030,670 | A | 4/1962 | Bigelow |
| 3,088,361 | A | 5/1963 | Hallock |
| 3,114,220 | A | 12/1963 | Maddox et al. |
| 3,121,978 | A | 2/1964 | Reiland |
| 3,183,628 | A | 5/1965 | Smith |
| 3,254,736 | A | 6/1966 | Gass |
| 3,277,626 | A | 10/1966 | Brynjolfsson et al. |
| 3,300,939 | A | 1/1967 | Brynjolfsson et al. |
| 3,309,828 | A | 3/1967 | Tribble |
| 3,310,926 | A | 3/1967 | Brandreth et al. |
| 3,341,998 | A | 9/1967 | Lucas |
| 3,342,005 | A | 9/1967 | Rickards et al. |
| 3,377,764 | A | 4/1968 | Storch |
| 3,478,480 | A | 11/1969 | Swenson |
| 3,563,131 | A | 2/1971 | Ridley, Sr. |
| 3,568,389 | A | 3/1971 | Gulow |
| 3,640,043 | A | 2/1972 | Querfeld et al. |
| 3,925,996 | A | 12/1975 | Wiggill |
| 3,964,226 | A | 6/1976 | Hala et al. |
| 3,964,227 | A | 6/1976 | Hala |
| 4,021,990 | A | 5/1977 | Schwalberg |
| 4,060,951 | A | 12/1977 | Gere |
| 4,227,359 | A | 10/1980 | Schlenker |
| 4,238,987 | A | 12/1980 | Siebrecht-Reuter |
| 4,281,494 | A | 8/1981 | Weinar |
| 4,305,239 | A | 12/1981 | Geraghty |
| 4,373,314 | A | 2/1983 | Allan |
| 4,382,416 | A | 5/1983 | Kellogg-Smith |
| 4,410,760 | A | 10/1983 | Cole |
| 4,424,745 | A | 1/1984 | Magorian et al. |
| 4,438,611 | A | 3/1984 | Bryant |
| 4,473,984 | A | 10/1984 | Lopez |
| 4,482,368 | A | 11/1984 | Roberts |
| 4,484,422 | A | 11/1984 | Roberts |
| 4,523,413 | A | 6/1985 | Koppenberg |
| 4,571,909 | A | 2/1986 | Berghuis et al. |
| 4,596,102 | A | 6/1986 | Catani et al. |
| 4,598,518 | A | 7/1986 | Hohmann |
| 4,606,163 | A | 8/1986 | Catani |
| 4,622,796 | A | 11/1986 | Aziz et al. |
| 4,628,657 | A | 12/1986 | Ermer et al. |
| 4,636,125 | A | 1/1987 | Burgard |
| 4,640,848 | A | 2/1987 | Cerdan-Diaz et al. |
| 4,660,342 | A | 4/1987 | Salisbury |
| 4,688,363 | A | 8/1987 | Sweeney et al. |
| 4,703,604 | A | 11/1987 | Muller |
| 4,708,551 | A | 11/1987 | Richter et al. |
| 4,714,507 | A | 12/1987 | Ohgushi |
| 4,738,070 | A | 4/1988 | Abbott et al. |
| 4,757,662 | A | 7/1988 | Gasser |
| 4,764,069 | A | 8/1988 | Reinwall et al. |
| 4,819,401 | A | 4/1989 | Whitney, Jr. |
| 4,827,684 | A | 5/1989 | Allan |
| 4,843,776 | A | 7/1989 | Guignard |
| 4,852,320 | A | 8/1989 | Ballantyne |
| 4,869,038 | A | 9/1989 | Catani |
| 4,869,043 | A | 9/1989 | Hatzinikolas et al. |
| 4,875,319 | A | 10/1989 | Hohmann |
| 4,911,949 | A | 3/1990 | Iwase et al. |
| 4,922,680 | A | 5/1990 | Kramer et al. |
| 4,946,632 | A | 8/1990 | Pollina |
| 4,955,172 | A | 9/1990 | Pierson |
| 5,063,722 | A | 11/1991 | Hohmann |
| 5,099,628 | A | 3/1992 | Noland et al. |
| 5,207,043 | A | 5/1993 | McGee et al. |
| 5,307,602 | A | 5/1994 | Lebraut |
| 5,392,581 | A | 2/1995 | Hatzinikolas et al. |
| 5,408,798 | A | 4/1995 | Hohmann |
| 5,440,854 | A | 8/1995 | Hohmann |
| 5,454,200 | A | 10/1995 | Hohmann |
| 5,456,052 | A | 10/1995 | Anderson et al. |
| 5,490,366 | A | 2/1996 | Burns et al. |
| 5,598,673 | A | 2/1997 | Atkins |
| 5,634,310 | A | 6/1997 | Hohmann |
| 5,644,889 | A | 7/1997 | Getz |
| 5,669,592 | A | 9/1997 | Kearful |
| 5,671,578 | A | 9/1997 | Hohmann |
| 5,673,527 | A | 10/1997 | Coston et al. |
| 5,755,070 | A | 5/1998 | Hohmann |
| 5,816,008 | A | 10/1998 | Hohmann |
| 5,819,486 | A | 10/1998 | Goodings |
| 5,845,455 | A | 12/1998 | Johnson, III |
| 5,953,865 | A | 9/1999 | Rickards |
| 6,000,178 | A | 12/1999 | Goodings |
| 6,098,364 | A | 8/2000 | Liu |
| 6,125,608 | A | 10/2000 | Charlson |
| 6,209,281 | B1 | 4/2001 | Rice |
| 6,279,283 | B1 | 8/2001 | Hohmann et al. |
| 6,284,311 | B1 | 9/2001 | Gregorovich et al. |
| 6,332,300 | B1 | 12/2001 | Wakai |
| 6,351,922 | B1 | 3/2002 | Burns et al. |
| 6,367,219 | B1 | 4/2002 | Quinlan |
| 6,508,447 | B1 | 1/2003 | Catani et al. |
| 6,548,190 | B2 | 4/2003 | Spitsberg et al. |
| 6,612,343 | B2 | 9/2003 | Camberlin et al. |
| 6,627,128 | B1 | 9/2003 | Boyer |
| 6,668,505 | B1 | 12/2003 | Hohmann et al. |
| 6,686,301 | B2 | 2/2004 | Li et al. |
| 6,718,774 | B2 | 4/2004 | Razzell |
| 6,735,915 | B1 | 5/2004 | Johnson, III |
| 6,739,105 | B2 | 5/2004 | Fleming |
| 6,789,365 | B1 | 9/2004 | Hohmann et al. |
| 6,812,276 | B2 | 11/2004 | Yeager |
| 6,817,147 | B1 | 11/2004 | MacDonald |
| 6,827,969 | B1 | 12/2004 | Skoog et al. |
| 6,837,013 | B2 | 1/2005 | Foderberg et al. |
| 6,851,239 | B1 | 2/2005 | Hohmann et al. |
| 6,918,218 | B2 | 7/2005 | Greenway |
| 6,925,768 | B2 | 8/2005 | Hohmann et al. |
| 6,941,717 | B2 | 9/2005 | Hohmann et al. |
| 6,968,659 | B2 | 11/2005 | Boyer |
| 7,007,433 | B2 | 3/2006 | Boyer |
| 7,017,318 | B1 | 3/2006 | Hohmann et al. |
| 7,043,884 | B2 | 5/2006 | Moreno |
| 7,059,577 | B1 | 6/2006 | Burgett |
| D527,834 | S | 9/2006 | Thimons et al. |
| 7,147,419 | B2 | 12/2006 | Balbo Di Vinadio |
| 7,152,382 | B2 | 12/2006 | Johnson, III |
| 7,171,788 | B2 | 2/2007 | Bronner |
| 7,178,299 | B2 | 2/2007 | Hyde et al. |
| D538,948 | S | 3/2007 | Thimons et al. |
| 7,225,590 | B1 | 6/2007 | diGirolamo et al. |
| 7,325,366 | B1 | 2/2008 | Hohmann, Jr. et al. |
| 7,334,374 | B2 | 2/2008 | Schmid |
| 7,374,825 | B2 | 5/2008 | Hazel et al. |
| 7,415,803 | B2 | 8/2008 | Bronner |
| 7,469,511 | B2 | 12/2008 | Wobber |
| 7,481,032 | B2 | 1/2009 | Tarr |
| 7,552,566 | B2 | 6/2009 | Hyde et al. |
| 7,562,506 | B2 | 7/2009 | Hohmann et al. |
| 7,587,874 | B2 | 9/2009 | Hohmann, Jr. |
| 7,654,057 | B2 | 2/2010 | Zambelli et al. |
| 7,735,292 | B2 | 6/2010 | Massie |
| 7,748,181 | B1 | 7/2010 | Guinn |
| 7,788,869 | B2 | 9/2010 | Voegele, Jr. |
| D626,817 | S | 11/2010 | Donowho et al. |

(56) References Cited

U.S. PATENT DOCUMENTS

| | | | |
|---|---|---|---|
| 7,845,137 | B2 | 12/2010 | Hohmann, Jr. |
| 8,037,653 | B2 | 10/2011 | Hohmann, Jr. |
| 8,051,619 | B2 | 11/2011 | Hohmann, Jr. |
| 8,096,090 | B1 | 1/2012 | Hohmann, Jr. et al. |
| 8,109,706 | B2 | 2/2012 | Richards |
| 8,122,663 | B1 | 2/2012 | Hohmann, Jr. et al. |
| 8,154,859 | B2 | 4/2012 | Shahrokhi |
| 8,201,374 | B2 | 6/2012 | Hohmann, Jr. |
| 8,209,934 | B2 | 7/2012 | Pettingale |
| 8,215,083 | B2 | 7/2012 | Toas et al. |
| 8,291,672 | B2 | 10/2012 | Hohmann, Jr. et al. |
| 8,347,581 | B2 | 1/2013 | Doerr et al. |
| 8,375,667 | B2 | 2/2013 | Hohmann, Jr. |
| 8,418,422 | B2 | 4/2013 | Johnson, III |
| 8,468,765 | B1 | 6/2013 | Kim |
| 8,511,041 | B2 | 8/2013 | Fransen |
| 8,516,763 | B2 | 8/2013 | Hohmann, Jr. |
| 8,516,768 | B2 | 8/2013 | Johnson, III |
| 8,544,228 | B2 | 10/2013 | Bronner |
| 8,555,587 | B2 | 10/2013 | Hohmann, Jr. |
| 8,555,596 | B2 | 10/2013 | Hohmann, Jr. |
| 8,596,010 | B2 | 12/2013 | Hohmann, Jr. |
| 8,609,224 | B2 | 12/2013 | Li et al. |
| 8,613,175 | B2 | 12/2013 | Hohmann, Jr. |
| 8,635,832 | B2 | 1/2014 | Heudorfer et al. |
| 8,661,766 | B2 | 3/2014 | Hohmann, Jr. |
| 8,667,757 | B1 | 3/2014 | Hohmann, Jr. |
| 8,726,596 | B2 | 5/2014 | Hohmann, Jr. |
| 8,726,597 | B2 | 5/2014 | Hohmann, Jr. |
| 8,733,049 | B2 | 5/2014 | Hohmann, Jr. |
| 8,739,485 | B2 | 6/2014 | Hohmann, Jr. |
| 8,800,241 | B2 | 8/2014 | Hohmann, Jr. |
| 8,833,003 | B1 | 9/2014 | Hohmann, Jr. |
| 8,839,581 | B2 | 9/2014 | Hohmann, Jr. |
| 8,839,587 | B2 | 9/2014 | Hohmann, Jr. |
| 8,844,229 | B1 | 9/2014 | Hohmann, Jr. |
| 8,863,460 | B2 | 10/2014 | Hohmann, Jr. |
| 8,881,488 | B2 | 11/2014 | Hohmann, Jr. et al. |
| 8,898,980 | B2 | 12/2014 | Hohmann, Jr. |
| 8,904,726 | B1 | 12/2014 | Hohmann, Jr. |
| 8,904,727 | B1 | 12/2014 | Hohmann, Jr. |
| 8,904,730 | B2 | 12/2014 | Hohmann, Jr. |
| 8,904,731 | B2 | 12/2014 | Hohmann, Jr. et al. |
| 8,910,445 | B2 | 12/2014 | Hohmann, Jr. |
| 8,978,330 | B2 | 3/2015 | Hohmann, Jr. |
| 9,038,351 | B2 | 5/2015 | Hohmann, Jr. |
| 2001/0054270 | A1 | 12/2001 | Rice |
| 2002/0047488 | A1 | 4/2002 | Webb et al. |
| 2002/0100239 | A1 | 8/2002 | Lopez |
| 2003/0121226 | A1 | 7/2003 | Bolduc |
| 2003/0217521 | A1 | 11/2003 | Richardson et al. |
| 2004/0083667 | A1 | 5/2004 | Johnson, III |
| 2004/0187421 | A1 | 9/2004 | Johnson, III |
| 2004/0216408 | A1 | 11/2004 | Hohmann, Jr. |
| 2004/0216413 | A1 | 11/2004 | Hohmann et al. |
| 2004/0216416 | A1 | 11/2004 | Hohmann et al. |
| 2004/0231270 | A1 | 11/2004 | Collins et al. |
| 2005/0046187 | A1 | 3/2005 | Takeuchi et al. |
| 2005/0279042 | A1 | 12/2005 | Bronner |
| 2005/0279043 | A1 | 12/2005 | Bronner |
| 2006/0005490 | A1 | 1/2006 | Hohmann, Jr. |
| 2006/0198717 | A1 | 9/2006 | Fuest |
| 2006/0242921 | A1 | 11/2006 | Massie |
| 2006/0251916 | A1 | 11/2006 | Arikawa et al. |
| 2007/0011964 | A1 | 1/2007 | Smith |
| 2008/0092472 | A1 | 4/2008 | Doerr et al. |
| 2008/0141605 | A1 | 6/2008 | Hohmann |
| 2008/0222992 | A1 | 9/2008 | Hikai et al. |
| 2009/0133351 | A1 | 5/2009 | Wobber |
| 2009/0133357 | A1 | 5/2009 | Richards |
| 2010/0037552 | A1 | 2/2010 | Bronner |
| 2010/0071307 | A1 | 3/2010 | Hohmann, Jr. |
| 2010/0101175 | A1 | 4/2010 | Hohmann |
| 2010/0192495 | A1 | 8/2010 | Huff et al. |
| 2010/0257803 | A1 | 10/2010 | Hohmann, Jr. |
| 2011/0023748 | A1 | 2/2011 | Wagh et al. |
| 2011/0041442 | A1 | 2/2011 | Bui |
| 2011/0047919 | A1 | 3/2011 | Hohmann, Jr. |
| 2011/0061333 | A1 | 3/2011 | Bronner |
| 2011/0083389 | A1 | 4/2011 | Bui |
| 2011/0146195 | A1 | 6/2011 | Hohmann, Jr. |
| 2011/0173902 | A1 | 7/2011 | Hohmann, Jr. et al. |
| 2011/0189480 | A1 | 8/2011 | Hung |
| 2011/0277397 | A1 | 11/2011 | Hohmann, Jr. |
| 2012/0186183 | A1 | 7/2012 | Johnson, III |
| 2012/0285111 | A1 | 11/2012 | Johnson, III |
| 2012/0304576 | A1 | 12/2012 | Hohmann, Jr. |
| 2012/0308330 | A1 | 12/2012 | Hohmann, Jr. |
| 2013/0008121 | A1 | 1/2013 | Dalen |
| 2013/0074435 | A1 | 3/2013 | Hohmann, Jr. |
| 2013/0074442 | A1 | 3/2013 | Hohmann, Jr. |
| 2013/0232893 | A1 | 9/2013 | Hohmann, Jr. |
| 2013/0232909 | A1 | 9/2013 | Curtis et al. |
| 2013/0247482 | A1 | 9/2013 | Hohmann, Jr. |
| 2013/0247483 | A1 | 9/2013 | Hohmann, Jr. |
| 2013/0247484 | A1 | 9/2013 | Hohmann, Jr. |
| 2013/0247498 | A1 | 9/2013 | Hohmann, Jr. |
| 2013/0340378 | A1 | 12/2013 | Hohmann, Jr. |
| 2014/0000211 | A1 | 1/2014 | Hohmann, Jr. |
| 2014/0075855 | A1 | 3/2014 | Hohmann, Jr. |
| 2014/0075856 | A1 | 3/2014 | Hohmann, Jr. |
| 2014/0075879 | A1 | 3/2014 | Hohmann, Jr. |
| 2014/0096466 | A1 | 4/2014 | Hohmann, Jr. |
| 2014/0174013 | A1 | 6/2014 | Hohmann, Jr. et al. |

FOREIGN PATENT DOCUMENTS

| | | |
|---|---|---|
| GB | 1 575 501 | 9/1980 |
| GB | 2 069 024 A | 8/1981 |
| GB | 2 246 149 A | 1/1992 |
| GB | 2 265 164 A | 9/1993 |
| GB | 2459936 B | 3/2013 |

OTHER PUBLICATIONS

ASTM Standard Specification A951/A951M—11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Building Code Requirements for Masonry Structures and Commentary, TMS 402-11/ACI 530-11/ASCE 5-11, 2011, Chapter 6, 12 pages.

Hohmann & Barnard, Inc., Product Catalog, 44 pgs (2003).

Hohmann & Barnard, Inc.; Product Catalog, 2009, 52 pages, Hauppauge, New York, United States.

Hohmann & Barnard, Inc., Product Catalog, 2013, 52 pages, Hauppauge, New York, United States.

Kossecka, PH.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

Canadian Office action for Application No. 2,836,937 dated Jan. 25, 2016, 5 pages.

ANCHORING SYSTEM HAVING HIGH-STRENGTH RIBBON LOOP ANCHOR

CROSS-REFERENCE TO RELATED APPLICATION

This application is a divisional of U.S. Ser. No. 13/727,290, filed Dec. 26, 2012, the entire contents of which are incorporated herein by reference.

BACKGROUND OF THE INVENTION

1. Field of the Invention

This invention relates to an improved anchoring arrangement for use in conjunction with cavity walls having a backup wall and a facing wall. More particularly, the invention relates to construction accessory devices, namely, high-strength anchors and anchoring systems. The anchors are specially configured to maintain a high strength interconnection with a truss or ladder reinforcement. The ribbon loop anchors of this invention resist deformation and interconnect with a variety of veneer ties. The invention is applicable to structures having a facing wall of brick or stone in combination with a backup wall of masonry block, seismic-resistant structures, and to cavity walls requiring thermal isolation.

2. Description of the Prior Art

In the past, investigations relating to the effects of various forces, particularly lateral forces, upon brick veneer masonry construction demonstrated the advantages of having high-strength wire anchoring components embedded in the bed joints of anchored cavity walls, such as facing brick or stone veneer.

With the promulgation of standards requiring higher strength components and concomitantly the expansion of the cavity of the wall to accommodate increased insulation, the technical demands on the anchoring systems have changed dramatically. Such changes, when analyzed, have resulted in wall structures or building envelopes wherein the forces applied at the interconnection between the wall anchor and the veneer tie increase result in added stress to the anchor interconnection joints. Prior tests have shown that failure of anchoring systems frequently occur at the juncture between the anchor receptor portion and the veneer tie. Deformation, including possible cracking, of the anchor receptor portion may result from the increased stresses thereby causing misalignment, which impacts on the structural integrity of the cavity wall. This invention addresses the need for a high-strength anchor and anchor receptor portion suitable for use with a ladder or truss wall reinforcement that provides a strong veneer tie-to-receptor connection.

Early in the development of high-strength anchoring systems a prior patent, namely U.S. Pat. No. 4,875,319 ('319), to Ronald P. Hohmann, in which a molded plastic clip is described as tying together reinforcing wire and a veneer tie was disclosed. The assignee of '319, Hohmann & Barnard, Inc., now a MiTek-Berkshire Hathaway company, successfully commercialized the device under the SeismiClip® trademark. For many years the white plastic clip tying together the veneer anchor and the reinforcement wire in the outer wythe has been a familiar item in commercial seismic-zone buildings. A later development by Hohmann & Barnard improving on the seismic structure includes a swaged back leg as shown in the inventor's patent, U.S. Pat. No. 7,325,366. The combination item reduces the number of "bits and pieces" brought to the job site and simplifies installation.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Thus, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

Besides earthquake protection requiring high-strength anchoring systems, the failure of several high-rise buildings to withstand wind and other lateral forces has resulted in the promulgation of more stringent Uniform Building Code provisions. This high-strength anchor is a partial response thereto. The inventor's related anchoring system products have become widely accepted in the industry.

In the past, the use of wire formatives have been limited by the mortar layer thicknesses which, in turn are dictated either by the new building specifications or by pre-existing conditions, e.g., matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283.

The following patents are believed to be relevant and are disclosed as being known to the inventor hereof:

| U.S. Patent No. | Inventor | Issue Date |
|---|---|---|
| 3,377,764 | Storch | April 16, 1968 |
| 4,021,990 | Schwalberg | May 10, 1977 |
| 4,373,314 | Allan | February 15, 1983 |
| 4,473,984 | Lopez | October 2, 1984 |
| 4,598,518 | Hohmann | July 8, 1986 |
| 4,869,038 | Catani | September 26, 1989 |
| 4,875,319 | Hohmann | October 24, 1989 |
| 5,454,200 | Hohmann | October 3, 1995 |
| 6,668,505 | Hohmann et al. | December 30, 2003 |
| 6,789,365 | Hohmann et al. | September 14, 2004 |
| 6,851,239 | Hohmann et al. | February 8, 2005 |
| 7,017,318 | Hohmann | March 28, 2006 |
| 7,325,366 | Hohmann | February 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—D. Storch—Issued Apr. 16, 1968 discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 discloses a dry wall construction system for anchoring a facing veneer to wallboard/metal stud construction with a pronged sheet metal anchor. Like Storch '764, the wall tie is embedded in the exterior wythe and is not attached to a straight wire run.

U.S. Pat. No. 4,373,314—J. A. Allan—Issued Feb. 15, 1983 discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986 discloses a dry wall construction system with wallboard attached to the face of studs which, in turn, are attached to an inner masonry wythe. Insulation is disposed between the webs of adjacent studs.

U.S. Pat. No. 4,869,038—M. J. Catani—Issued Sep. 26, 1989 discloses a veneer wall anchor system having in the interior wythe a truss-type anchor, and horizontal sheet metal extensions. The extensions are interlocked with bent wire pintle-type wall ties that are embedded within the exterior wythe.

U.S. Pat. No. 4,875,319—R. Hohmann—Issued Oct. 24, 1989 discloses a seismic construction system for anchoring a facing veneer to wallboard/metal stud construction with a pronged sheet metal anchor. Wall tie is distinguished over that of Schwalberg '990 and is clipped onto a straight wire run.

U.S. Pat. No. 5,454,200—R. Hohmann—Issued October 1995 discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003 discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—R. Hohmann et al.—Issued Sep. 14, 2004 discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005 discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006 discloses an anchoring system with low-profile wall ties in which insertion portions of the wall anchor and the veneer anchor are compressively reduced in height.

U.S. Pat. No. 7,325,366—Hohmann—Issued Feb. 5, 2008 discloses snap-in veneer ties for a seismic construction system in cooperation with low-profile, high-span wall anchors.

None of the above anchors or anchoring systems provide an anchoring system having a high-strength anchor and ribbon loop receptor for fulfilling the need for enhanced compressive and tensile properties. This invention relates to an improved anchoring arrangement for use in conjunction with cavity walls and meets the heretofore unmet need described above.

SUMMARY

In one aspect of the present invention, a high-strength ribbon loop anchor and an anchoring system utilizing the same are used in cavity walls having a backup wall and a facing wall. The system includes a wire-formative veneer tie for emplacement in the mortar joints of the facing wall. The high-strength construction system hereof is applicable to construction of a wall having a masonry backup wall and a facing wall of brick, block or similar materials, and to insulated and non-insulated structures. In the disclosed system, a unique combination of a wall anchor (affixed to either a ladder- or truss-type reinforcement), a wire veneer tie, and, optionally, a continuous wire reinforcement for a seismic structure is provided. The invention provides a wall anchor with compressed components including ribbon loops, for interengagement with a veneer tie.

In some embodiments of this invention, the wall anchor is affixed to the wall reinforcement through a method of fusible attachment. The wall anchor ribbon loops are compressively reduced and include a secure eyelet for interconnection with a veneer tie. The ribbon loop is disposed substantially vertical in the cavity, with the major cross-sectional axis of the ribbon loop oriented to be subject to the greatest compressive and tensile forces, creating a secure and high-strength interconnection between the wall anchor and the veneer tie.

The anchoring system comprises at least one wall anchor having a ribbon loop. Single wall anchors are optionally joined by a rear leg. The wall anchor includes wire formative components that are selectively reduced and compressed, providing for greater tensile strength. The veneer tie is a wire formative that may be compressed for a low-profile veneer tie and swaged for interconnection with a reinforcement wire.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENT

Figure 1:
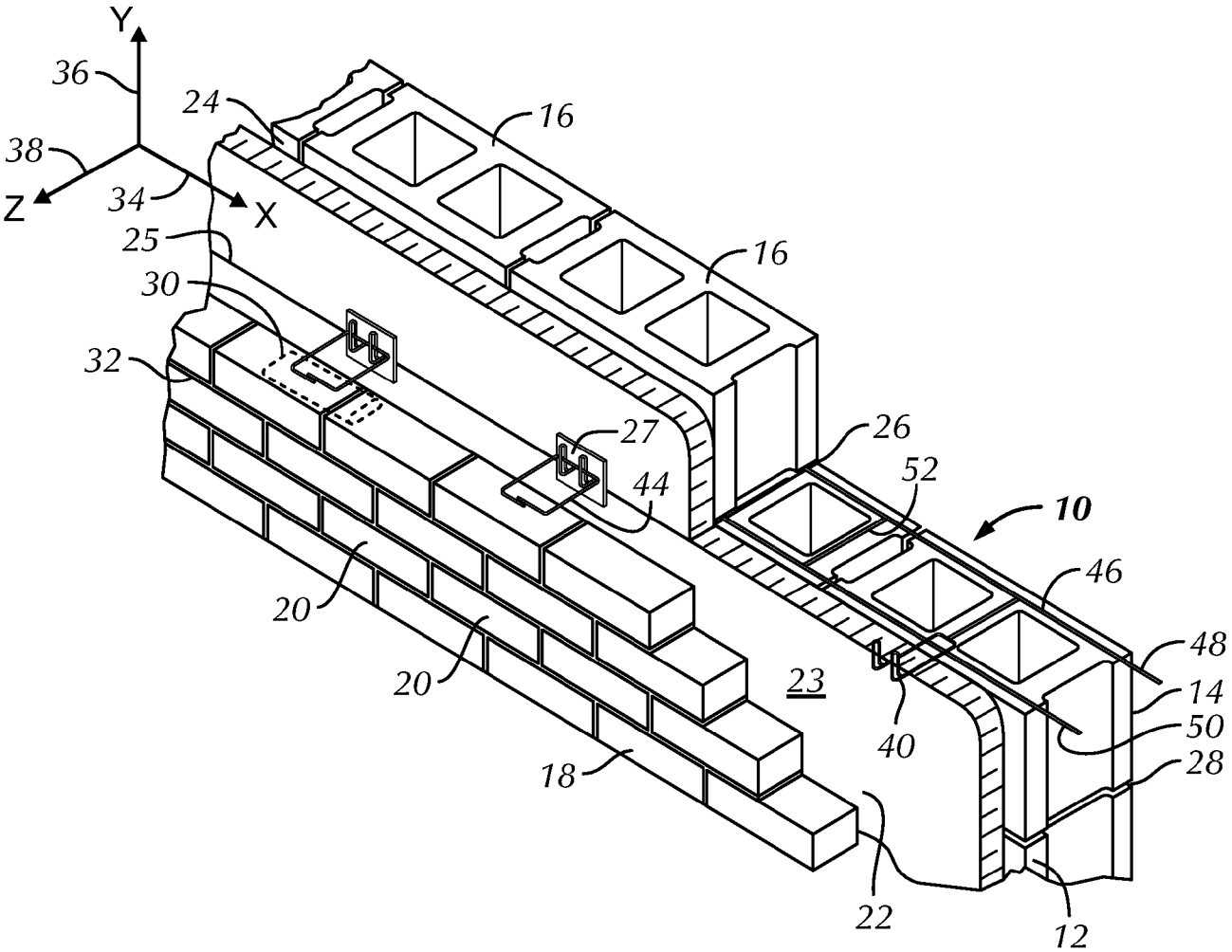
FIG. 1 is a perspective view of a first embodiment of an anchoring system having a high-strength ribbon loop anchoring system of this invention with interconnected veneer tie and shows a wall with backup wall of masonry block with insulation thereon, a facing wall of brick veneer and a ladder reinforcement.

In the embodiments described herein, the interengaging portion and the insertion portion of the wire formative components of the veneer ties are cold-worked or otherwise partially flattened and specially configured resulting in greater tensile and compressive strength and thereby becoming better suited to cavity walls wherein high wind loads or seismic forces are experienced. It has been found that, when the appropriate metal alloy is cold-worked, he desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheet metal counterpart.

Before proceeding to the detailed description, the following definitions are provided. For purposes of defining the invention at hand, a compressively reduced wire formative is a wire formative that has been compressed by cold working so that the resultant body is substantially semicircular at the edges and has flat surfaces therebetween. In use, the rounded edges are aligned so as to receive compressive forces transmitted from the veneer or outer wythe, which forces are generally normal to the facial plane thereof. In the discussion that follows the width of the compressed interengaging portion is also referred to as the major axis and the thickness is referred to as the minor axis.

As the compressive forces are exerted on the compressed portion, the compressed portion withstand forces greater than uncompressed portions of the wire formative formed from the same gage wire. Data reflecting the enhancement represented by the coldworked compressed portion is included hereinbelow.

When stronger joint reinforcements are required in the inner wythe or backup wall to support the stresses imparted by anchoring the outer wythe or facing wall, as described hereinbelow, this is accomplished while still maintaining building code requirements for masonry structures, including the mortar bed joint height specification—most commonly 0.375 inches. Although thicker gage wire formatives are used when required for greater strength, it is still desirable to have the bed joint mortar cover the wall anchor structure. Thus, the wall reinforcements are usually structured from 0.148 or 0.187 inch wire, and, in practical terms, the wire formatives hereof that are inserted into the bed joints of the inner and outer wythes have a height limited to approximately 0.187 inch.

In the detailed description, the wall reinforcements, the wall anchors, and the veneer ties are wire formatives. The wire used in the fabrication of masonry joint reinforcement conforms to the requirements of ASTM Standard Specification A951-00, Table 1. For the purpose of this application weld shear strength tests, tensile strength tests and yield tests of masonry joint reinforcements are, where applicable, those denominated in ASTM A-951-00 Standard Specification for Masonry Joint Reinforcement. In the descriptions of ribbon loop anchors which follow, the anchors are affixed to the ladder-type or the truss-type reinforcements. As the attachment methodology follows that of fabricating the Masonry Joint Reinforcements, the tests for the wall anchors, except where fixturing is dictated by configuration, follow the A-951 procedures.

Another term defined for purposes of this application is wall reinforcement. A wall reinforcement is a continuous length of Lox All® Truss Mesh or Lox All® Ladder Mesh manufactured by Hohmann & Barnard, Inc., Hauppauge, N.Y. 11788 or equivalent adapted for embedment into the horizontal mortar joints of masonry walls. The wall reinforcements are prefabricated from cold-drawn steel wire and have parallel side rods with interconnected cross rods or truss components. The wall reinforcements for anchoring systems are generally structured from wire that is at least 0.148 and 0.187 inch in diameter.

The description which follows is of three embodiments of anchoring systems utilizing the high-strength ribbon loop anchor devices of this invention, which devices are suitable for nonseismic and seismic cavity wall applications. The embodiments apply to cavity walls with masonry block backup walls and facing walls of concrete block, brick, stone or the like.

Referring now to FIGS. 1 through 4 and 12, the first embodiment of a ribbon loop anchor and reinforcement device for a cavity wall is shown and is referred generally by the numeral 10. In this embodiment, a cavity wall structure 12 is shown having an inner wythe or backup wall 14 of masonry blocks 16 and an outer wythe or facing wall 18 of brick 20. Between the inner wythe 14 and the outer wythe 18, a cavity 22 is formed, which cavity 22 extends outwardly from surface 24 of backup wall 14.

The cavity 22 is optionally insulated with strips of insulation 23 attached to the exterior surface 24 of the inner wythe 14 and having seams 25 between adjacent strips 23 coplanar with adjacent bed joints 26 and 28. The cavity 22 has a 3-inch span as exemplary. Successive bed joints 26 and 28 are formed between courses of blocks 16 and mortar-filled. The bed joints 26 and 28 are substantially planar and horizontally disposed, and in accord with building standards, are 0.375-inch (approx.) in height. Also, successive bed joints 30 and 32 are formed between courses of bricks 20 and the joints are substantially planar and horizontally disposed. Selected bed joint 26 and bed joint 30 are constructed to be align, that is to be substantially coplanar, the one with the other.

For purposes of discussion, the cavity surface 24 of the backup wall 14 contains a horizontal line or x-axis 34 and an intersecting vertical line or y-axis 36. A horizontal line or z-axis 38, normal to the xy-plane, passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis.

Figure 2:
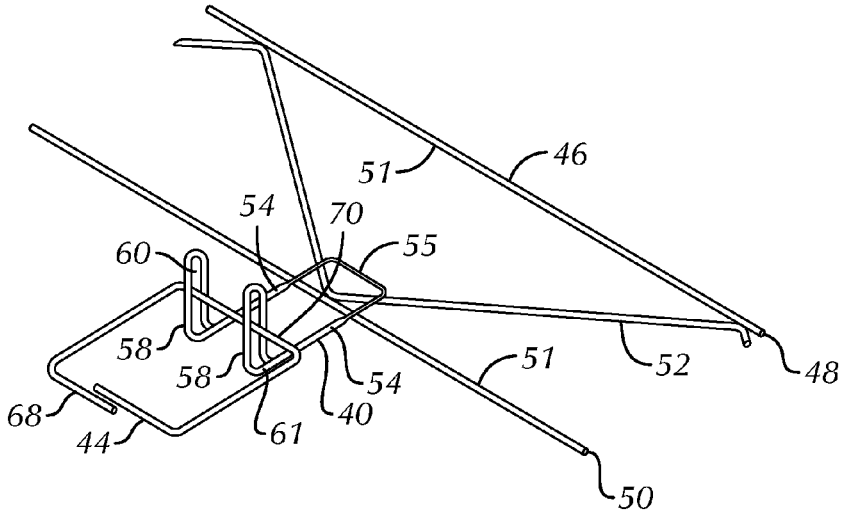
FIG. 2 is a partial perspective view of the first embodiment similar to FIG. 1 showing details of the ribbon loop wall anchor and the veneer tie with a truss reinforcement.

The wall reinforcement 46 is shown in FIG. 1 as a ladder-type reinforcement and FIG. 2 as a truss-type reinforcement for emplacement on a course of blocks 16 in preparation for embedment in the mortar of bed joint 26. The wall reinforcement 46 is constructed of a wire formative with two parallel continuous straight side wires 48 and 50 spaced so as, upon installation, to each be centered along the outer walls of the masonry blocks 16. An intermediate wire bodies or cross rod 52 are interposed therebetween and are affixed to the interior sides 51 of the side wires 48, 50 maintaining the parallelism thereof.

At intervals along the wall reinforcement 46, wire formative wall anchors 40 are fusibly attached through welding, TOX clinch or any similar method which produces a high-strength connection. The wall anchors 40 have leg portions 54 extending toward the cavity 22. Contiguous with the leg portions 54 are ribbon cavity portions 56. A ribbon loop 58 is contiguous with the ribbon cavity portion 56 and configured to interengage with a veneer tie 44. The leg portions 54 are connected by a rear leg 55 and fusibly attached to the intermediate wire 48. The spacing between the leg portions 54 is constructed to limit the x-axis 34 movement of the construct. The ribbon cavity portions 56 and the ribbon loops 58 are considerably compressively reduced, while maintaining the same mass of material per linear unit as the uncompressed wire formative, forming a thick ribbon-like appearance. As more clearly seen in FIGS. 3 and 4, the ribbon loops 58 have been compressively reduced so that, when viewed as installed, the ribbon loops 58 cross-section taking in a horizontal or an xz-plane shows the greatest dimension 63 substantially oriented along a z-vector. The cold working enhances the mounting strength of the wall anchor 40 and resists force vectors along the z-axis 38.

Figure 7:
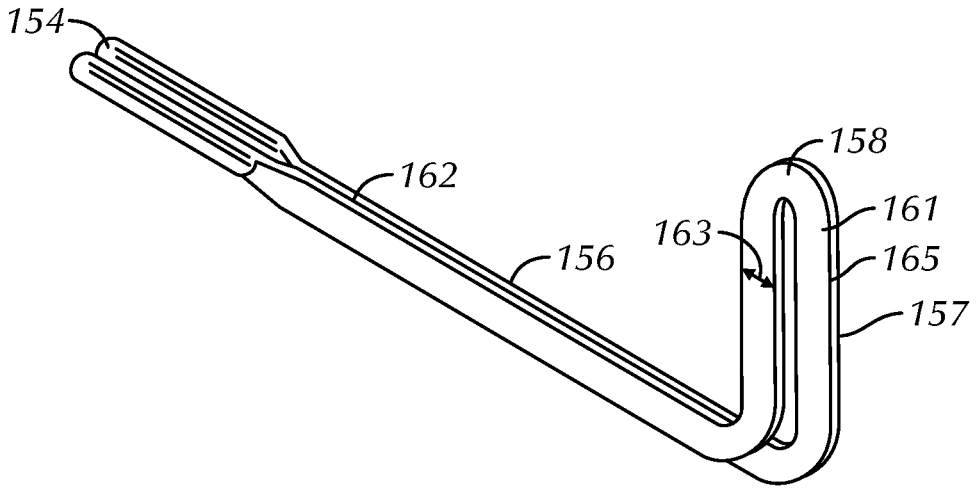
FIG. 7 is a perspective view of an alternative ribbon loop anchor of FIG. 5.
Figure 8:
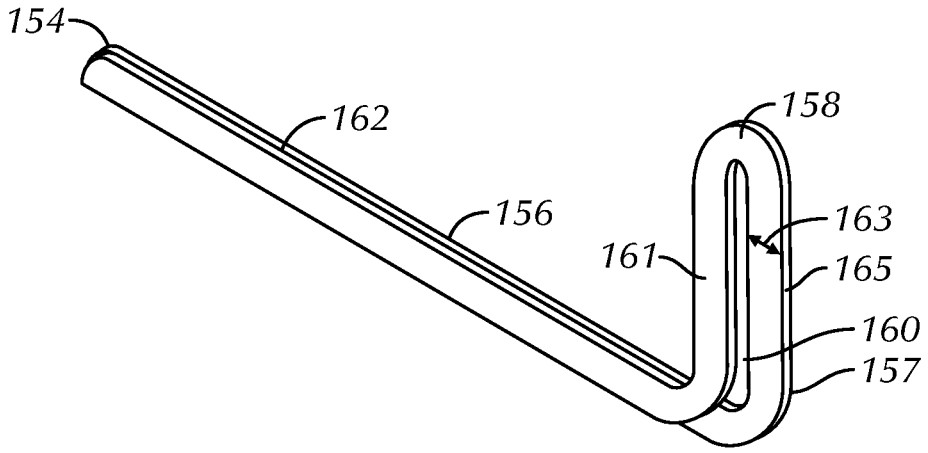
FIG. 8 is a perspective view of an alternative ribbon loop anchor of FIG. 5.

The ribbon loop 58 forms an eyelet 61 that is, upon installation, substantially vertical in the cavity 22. The eyelet 61 is sealed through welding or a similar process forming a closed loop and is elongated with a substantially oval opening 60 with a diameter designed to maintain a close fitting relationship with the interengaging end portion 70 of the veneer tie 44. Wythe-to-wythe and side-to-side movement is limited by the close fitting relationship between the compressively reduced ribbon loop 58 and the veneer tie 44 interengaging end portion 70. The eyelet 61 is dimensioned to accept the interengaging end portion 70 of the veneer tie or anchor 44 therethrough and has a slightly larger opening than that required to accommodate the veneer tie 44. This relationship minimizes the movement of the construct in along a z-vector and in an xz-plane. To ensure a high-strength weld of the ribbon loop 58, the loop is extended to overlap the ribbon cavity portion 56 and may be extended to the length of the ribbon cavity portion 56 as shown in FIGS. 7 and 8.

The minor axis 65 of the compressively reduced loop 58 and ribbon cavity portion 56 is optimally between 30 to 75% of the diameter (up to 0.375-inch) of the wire formative and results in the anchor 40 having compressive/tensile strength 140% of the original wire formative material. Optionally, the minor axis 65 of the compressively reduced loop 58 and ribbon cavity portion 56 are fabricated from either 0.250-inch diameter wire (resulting in the anchor 40 having compressive/tensile strength rating at least 200% greater than the rating for a non-reduced wire) or 0.187-inch diameter wire (resulting in the anchor 40 having compressive/tensile strength rating at least 100% greater than the rating for a non-reduced wire). The ribbon loop 58 and the ribbon cavity portion 56, once compressed, are ribbon-like in appearance; however, maintain substantially the same cross sectional area as the wire formative body. The ribbon loop 58 is formed contiguously with the ribbon cavity portion 56 and the major cross-sectional axes 63 of the ribbon loop 58 are substantially parallel to the wall reinforcement 46. Optionally, for ease of manufacture, the leg portions 54 and/or the rear leg 55 are similarly compressively reduced. To further secure the insulation 23, retention plates 27 are optionally employed.

A veneer tie 44 is interconnected with the anchor 40 for embedment in bed joint 30. The veneer tie or anchor 44 is, when viewed from a top or bottom elevation, generally rectangular in shape and is a basically planar body. The veneer anchor 44 is dimensioned to be accommodated by the ribbon loop 58. The veneer tie 44 has an interengaging end portion 70 for disposition in the ribbon loop 58 and an insertion end portion 68 for disposition in the bed join 30 of the facing wall 18.

Figure 5:
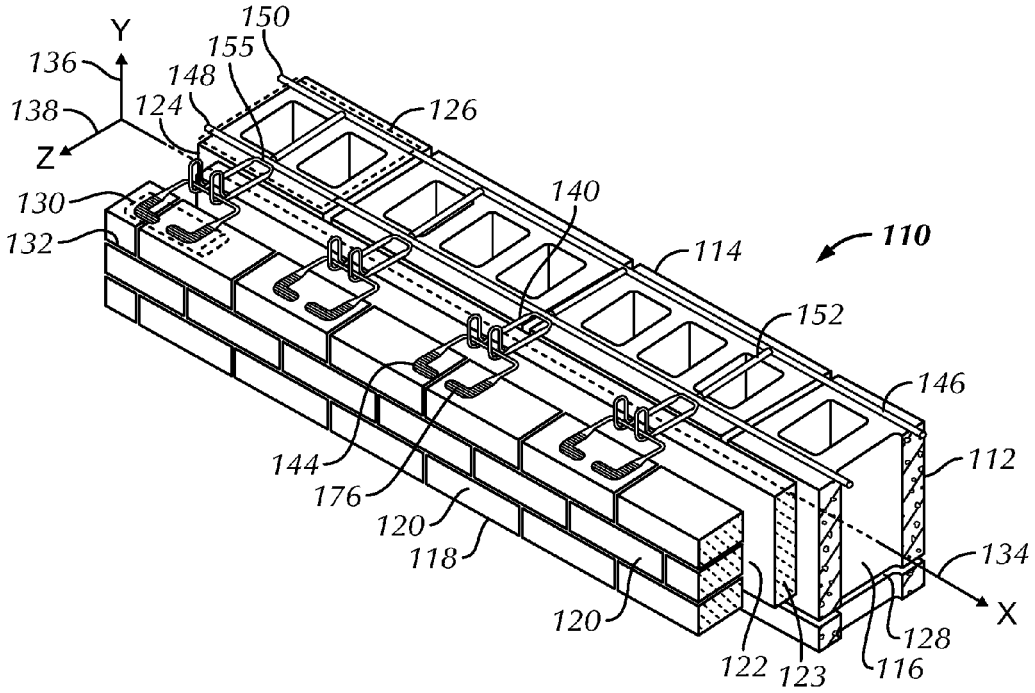
FIG. 5 is a perspective view of a second embodiment of a high-strength ribbon loop anchoring device of this invention with an interconnecting veneer tie, the ribbon loop anchor is side-welded to the wall reinforcement, and shows a wall with a backup wall of masonry block with insulation a brick facing wall.
Figure 9:
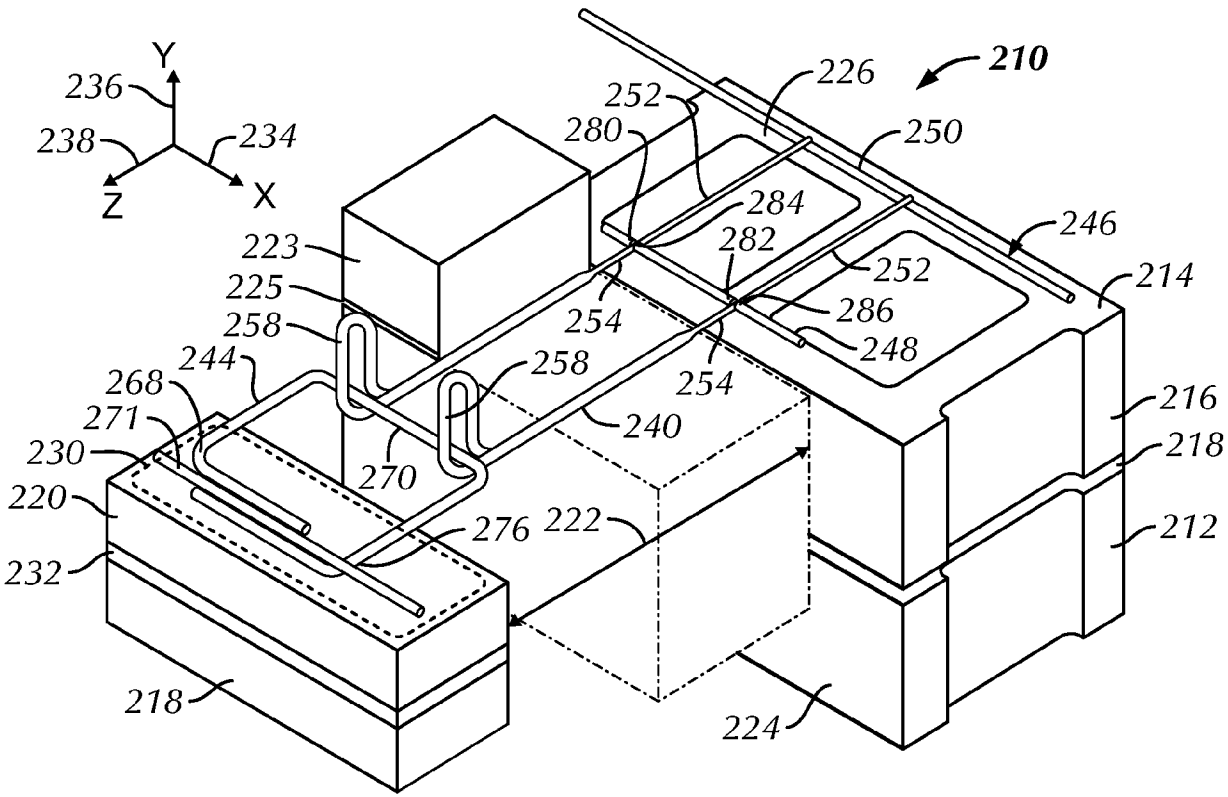
FIG. 9 is a partial perspective view of a third embodiment of a high-strength ribbon loop anchoring device of this invention with an interconnecting veneer tie and reinforcement wire, and shows a partially constructed cavity wall with insulation.

The box-shaped veneer anchor 44 is optimally a box tie similar to that of the Byna-Lok® of Hohmann & Barnard. The ribbon loops 58 of the wall anchor 40 are constructed so that with insertion of the veneer tie 44 through eyelet 61, the misalignment between bed joints tolerated is approximately one-half the vertical spacing between adjacent bed joints of the facing brick course. As described in the embodiments below, the veneer tie 44 is optionally compressed to form a low profile veneer tie 144, as shown in FIG. 5. Upon compression, a pattern or corrugation 176 is impressed. Alternatively, the veneer tie 44 is swaged 276 to accommodate a reinforcement wire 271, as shown in FIG. 9, to form a seismic structure.

The description which follows is of a second embodiment of the ribbon loop anchoring system. For ease of comprehension, where similar parts are shown, reference designators "100" units higher than those previously employed are used. Thus, the veneer tie 144 of the second embodiment is analogous to the veneer tie 44 of the first embodiment. Referring now to FIGS. 5 through 8 and 12, the second embodiment of a high-strength ribbon loop anchoring system of this invention is shown and is referred generally by the numeral 110.

In this embodiment, a cavity wall structure 112 is shown having an inner wythe or backup wall 114 of masonry blocks 116 and an outer wythe or facing wall 118 of brick 120. Between the inner wythe 114 and the outer wythe 118, a cavity 122 is formed, which cavity 122 extends outwardly from surface 124 of backup wall 114.

The cavity 122 is optionally insulated with strips of insulation 123 attached to the exterior cavity or vertical surface 124 of the inner wythe 114. The cavity 122 has a 3-inch span as exemplary. Successive bed joints 126 and 128 are formed between courses of blocks 116 and mortar-filled. The bed joints 126 and 128 are substantially planar and horizontally disposed and in accord with building standards are 0.375-inch (approx.) in height. Also, successive bed joints 130 and 132 are formed between courses of bricks 120 and the joints are substantially planar and horizontally disposed. Selected bed joint 126 and bed joint 130 are constructed to align, that is to be substantially coplanar, the one with the other.

For purposes of discussion, the cavity surface 124 of the backup wall 114 contains a horizontal line or x-axis 134 and an intersecting vertical line or y-axis 136. A horizontal line or z-axis 138, normal to the xy-plane, passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis.

Figure 6:
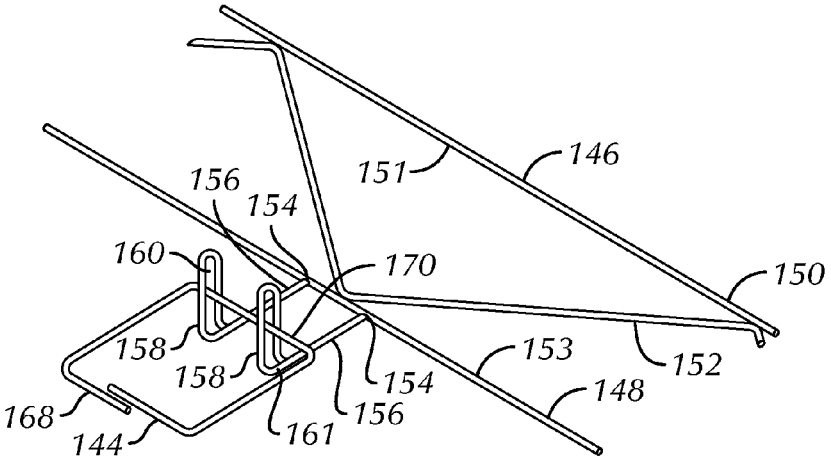
FIG. 6 is a partial perspective view of the anchoring system of FIG. 5.
Figure 3:
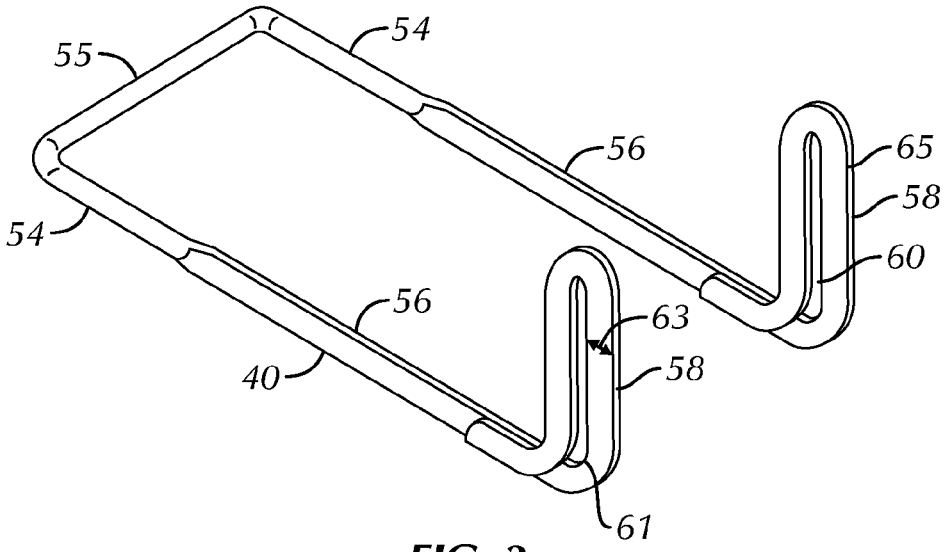
FIG. 3 is a perspective of the ribbon loop anchor of FIG. 2.
Figure 4:
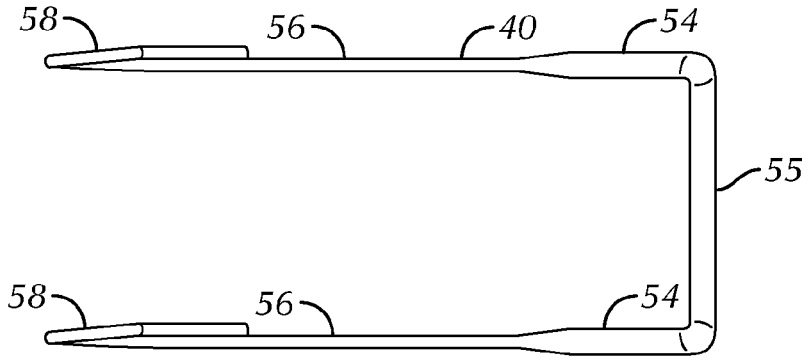
FIG. 4 is a top plan view of the ribbon loop anchor of FIG. 2.

The wall reinforcement 146 is shown in FIG. 5 as a ladder-type reinforcement and FIG. 6 as a truss-type reinforcement for emplacement on a course of blocks 116 in preparation for embedment in the mortar of bed joint 126. The wall reinforcement 146 is constructed of a wire formative with two parallel continuous straight side wires 148 and 150 spaced so as, upon installation, to each be centered along the outer walls of the masonry blocks 116. Intermediate wire bodies or cross rod 152 are interposed therebetween and are affixed to the side wires 148, 150 maintaining the parallelism thereof. The wall reinforcement 146 has an upper surface 151 in one plane and a lower surface 153 in a plane substantially parallel thereto.

At intervals along the wall reinforcement 146, wire formative wall anchors 140 are fusibly attached at an attachment end 154 to the side wire 148 through welding, TOX clinch or any similar method which produces a high-strength connection. The wall anchors 140 have extended leg portions 156 that span the cavity 122. Contiguous with the extended leg portion 156 is a free end 157 set opposite the attachment end 154. A ribbon loop 158 is formed from the free end 157 and configured to interengage with a veneer tie 144. The wall anchors 140 include single unconnected extended leg portion 156 and attachment end 154 as shown in FIGS. 6 through 8 or comprise two extended leg portions 156 and attachment ends 154 fusibly connected by a rear leg 155 (as shown in FIG. 5). The spacing between the extended leg portion 156 is constructed to limit the x-axis movement of the construct. The extended leg portion 156, including the ribbon loop 158 are considerably compressively reduced, while maintaining the same mass of material per linear unit as the uncompressed wire formative, forming a thick ribbon-like appearance.

As more clearly seen in FIGS. 7 and 8, the extended leg portions 156 and the ribbon loops 158 have been compressively reduced so that, when viewed as installed, the ribbon loop 158 cross-section taking in a horizontal or an xz-plane shows the greatest dimension 163 substantially oriented along a z-vector. Similarly, when viewed as installed, the ribbon loop 158 cross-section taking in a vertical plane shows the major axis dimension 163 substantially oriented along a z-vector and parallel to the upper surface 151 of the wall reinforcement 146. The cold working enhances the mounting strength of the wall anchor 140 and resists force vectors along the z-axis 138.

The ribbon loop 158 forms an eyelet 161 that is, upon installation, substantially vertical in the cavity 122. The eyelet 161 is sealed through welding or a similar process forming a closed loop and is elongated with a substantially oval opening 160 with a diameter designed to maintain a close fitting relationship with the interengaging end portion 170 of the veneer tie 144. Wythe-to-wythe and side-to-side movement is limited by the close fitting relationship between the compressively reduced ribbon loop 158 and the veneer tie 144 interengaging end portion 170. The eyelet 161 is dimensioned to accept the interengaging end portion 170 of the veneer tie or anchor 144 therethrough and has a slightly larger opening than that required to accommodate the veneer tie 144. This relationship minimizes the movement of the construct in along a z-vector and in an xz-plane. To ensure the high-strength of the ribbon loop 158, the wall anchor 140 is formed from a single wire formative. The wall anchor is optionally fusibly joined at the overlapping compressively formed locations 162 as shown in FIGS. 7 and 8.

The minor axis 165 of the compressively reduced loop 158 is optimally between 30 to 75% of the diameter (up to 0.375-inch) of the wire formative and results in the anchor 140 having compressive/tensile strength 140% of the original wire formative material. Optionally, the minor axis 165 of the compressively reduced loop 158 is fabricated from either 0.250-inch diameter wire (resulting in the anchor 140 having compressive/tensile strength rating at least 200% greater than the rating for a non-reduced wire) or 0.187-inch diameter wire (resulting in the anchor 140 having compressive/tensile strength rating at least 100% greater than the rating for a non-reduced wire). The ribbon loop 158 and the extended leg portion 156, once compressed, are ribbon-like in appearance; however, maintains substantially the same cross sectional area as the wire formative body. The ribbon loop 158 is formed from the extended leg portion 156. Optionally, for ease of manufacture, the attachment end 154 is similarly compressively reduced.

A veneer tie 144 is interconnected with the anchor 140 for embedment in bed joint 130. The veneer tie or anchor 144 is, when viewed from a top or bottom elevation, generally rectangular in shape and is a basically planar body. The veneer anchor 144 is dimensioned to be accommodated by the ribbon loop 158. The veneer tie 144 has an interengaging end portion 170 for disposition in the ribbon loop 158 and an insertion end portion 168 for disposition in the bed joint 130 of the facing wall 118.

The box-shaped veneer anchor 144 is optimally a box tie similar to that of the Byna-Lok® of Hohmann & Barnard. The ribbon loops 158 of the wall anchor 140 are constructed so that with insertion of the veneer tie 144 through eyelet 161, the misalignment between bed joints tolerated is approximately one-half the vertical spacing between adjacent bed joints of the facing brick course. As described in the embodiments below, the veneer tie 144 is optionally compressed to form a low profile veneer tie 144, as shown in FIG. 5. Upon compression, a pattern or corrugation 176 is impressed. Alternatively, the veneer tie 144 is swaged 276 to accommodate a reinforcement wire 271, as shown in FIG. 9, to form a seismic structure.

The description which follows is of a third embodiment of the high-strength ribbon loop anchoring system. For ease of comprehension, where similar parts are used reference designators "200" units higher are employed. Thus, the veneer tie 244 of the third embodiment is analogous to the veneer tie 44 of the first embodiment and the veneer tie 144 of the second embodiment.

Referring now to FIGS. 9 through 12, the third embodiment of a ribbon loop anchoring system of this invention is shown and is referred to generally by the numeral 210. In this embodiment, a wall structure 212 is shown having an inner wythe or backup wall 214 of masonry blocks 216 and an outer wythe or facing wall 218 of facing stone 220. Between the inner wythe 214 and the outer wythe 218, a cavity 222 is formed, which cavity 222 has an exterior surface 224. In the third embodiment, successive bed joints 226 and 228 are formed between courses of blocks 216 and the joints are substantially planar and horizontally disposed. Also, successive bed joints 230 and 232 are formed between courses of facing stone or brick 220 and the joints are substantially planar and horizontally disposed. For each structure, the bed joints 226, 228, 230 and 232 are specified as to the height or thickness of the mortar layer and such thickness specification is rigorously adhered to so as to provide the uniformity inherent in quality construction. Selected bed joint 226 and bed joint 230 are constructed to align, that is to be substantially coplanar, the one with the other.

For purposes of discussion, the exterior surface 224 of the inner wythe 214 contains a horizontal line or x-axis 234 and an intersecting vertical line or y-axis 236. A horizontal line or z-axis 238 normal to the xy-plane also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The system 210 includes a masonry wall reinforcement 246 constructed for embedment in bed joint 226, which, in turn, is configured to mount wall anchors 240 at attachment sites 284, 286.

The components of the anchoring system 210 are shown in FIG. 9 as being emplaced on a course of blocks 216 and facing stone or brick 220 in preparation for embedment in the mortar of bed joints 226 and 230, respectively. In the best mode of practicing the invention, a combined box ladder-type wall reinforcement 246 and wall anchor 240 are constructed of a wire formative with two parallel continuous straight wire members 248 and 250 spaced so as, upon installation, to each be centered along the outer walls of the masonry blocks 216. The structure further includes intermediate wire bodies or cross rod portions 252 interposed therebetween and connecting wire members 248 and 250. These cross rod portions 252 form rung-like elements of the reinforcement structure 246. The cross rod portions 252, at intervals along the wall reinforcement 246, extend across wire members 248 and provide spaced pairs of wall anchors 240. The other end of cross rod portions 252 are affixed by welding or similar process to wire reinforcement 250. The wall anchors 240 are contiguous with the cross rod portions 252 and extend across the cavity 222 to veneer tie 244. As will become clear by the description which follows, the spacing between the attachment end 254 is constructed to limit the x-axis movement of the construct.

For the wall reinforcement 246, swaged into the cross rod portions 252 of wall anchor 240 are indentations 280 and 282 at attachment sites 284 and 286, respectively. During assembly, the two components—the wall anchor 240 and the wall reinforcement 246—are fusibly joined at attachment sites 284 and 286 under heat and pressure. Upon assembly, the attachment sites 284 and 286 have a height no greater than the diameter of the wire of wall anchor 240. Thus, for example, if the 0.187-inch diameter wire is employed for all components, upon insertion of the assemblage into bed joint 226 an equal height of mortar would surround the wall reinforcement 246 and the attachment end 254 of the wall anchor 240. Similarly because of the flatness of the combined wall reinforcement 246 and wall anchor 240 assemblage, the ability to maintain verticality of the backup wall 214 is enhanced. Each anchor 240 has a ribbon loop portion 258 set opposite the attachment end 254.

Figure 10:
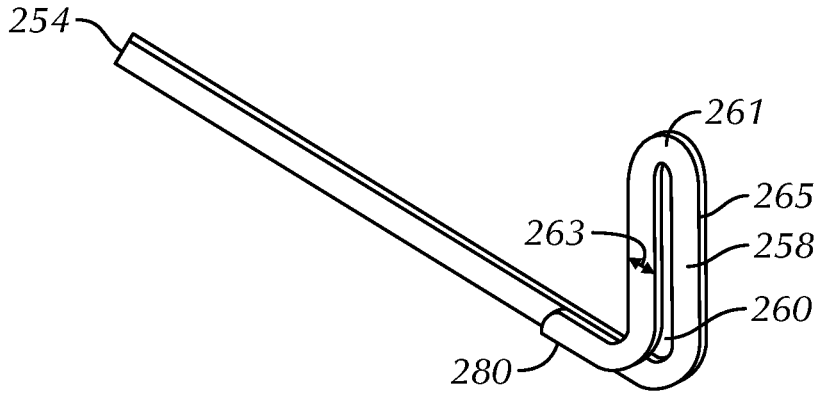
FIG. 10 is a perspective view of the ribbon loop anchor of FIG. 9.
Figure 11:
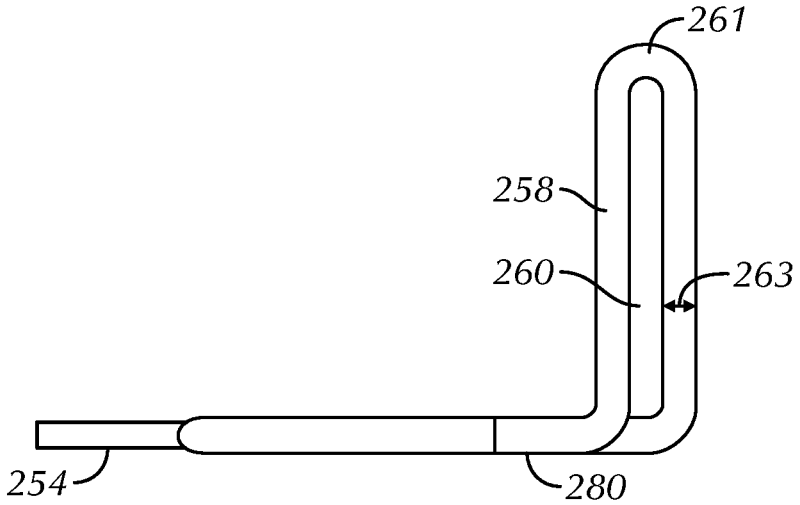
FIG. 11 is a side view of an alternative ribbon loop anchor for use with the anchoring system of FIG. 10; and, FIG. 12 is a cross-sectional view of cold-worked wire used in the formation of the compressively reduced wall anchors hereof and showing resultant aspects of continued compression.
Figure 12:
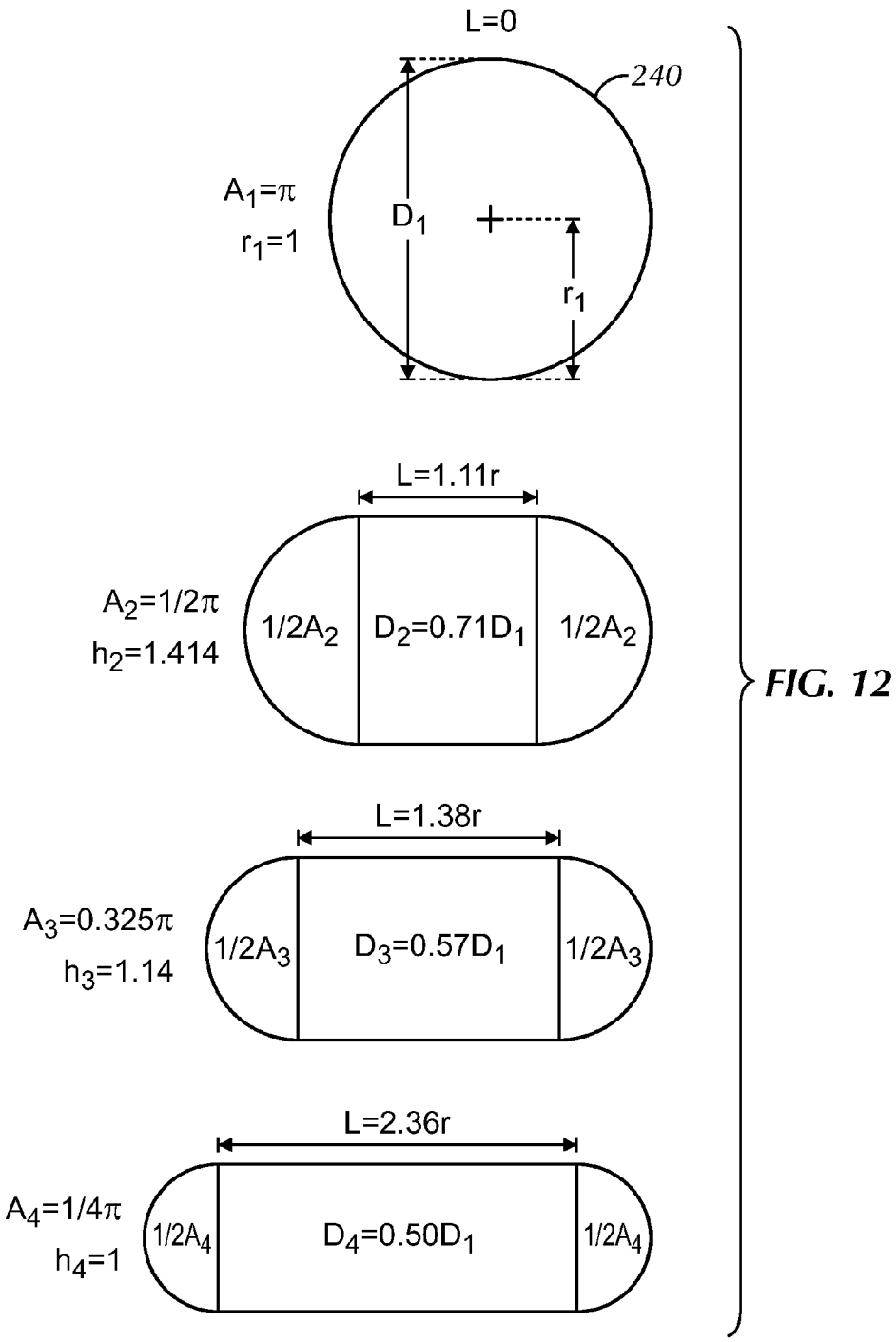

As more clearly seen in FIGS. 10 and 11, the ribbon loops 258 have been compressively reduced so that, when viewed as installed, the ribbon loop's cross-section taken in a horizontal or an xz-plane shows the greatest dimension 263 substantially oriented along a z-vector. Similarly, when viewed as installed, the ribbon loops 258 cross-section taking in a vertical plane shows the major axis dimension 263 substantially oriented along a z-vector and parallel to the wall reinforcement 246. The cold working enhances the mounting strength of the wall anchor 240 and resists force vectors along the z-axis 238.

The ribbon loop 258 forms an eyelet 261 that is, upon installation, substantially vertical in the cavity 222. The eyelet 261 is sealed through welding or a similar process forming a closed loop and is elongated with a substantially oval opening 260 with a diameter designed to maintain a close fitting relationship with the interengaging end portion 270 of the veneer tie 244. Wythe-to-wythe and side-to-side movement is limited by the close fitting relationship between the compressively reduced ribbon loop 258 and the veneer tie 244 interengaging end portion 270. The eyelet 261 is dimensioned to accept the interengaging end portion 270 of the veneer tie or anchor 244 therethrough and has a slightly larger opening than that required to accommodate the veneer tie 244. This relationship minimizes the movement of the construct in along a z-vector and in an xz-plane. To ensure the high-strength of the ribbon loop 258, the wall anchor 240 is formed from a single wire formative. The wall anchor is fusibly joined at the overlapping compressively formed locations 280 as shown in FIGS. 10 and 11.

The minor axis 265 of the compressively reduced loop 258 is optimally between 30 to 75% of the diameter (up to 0.375-inch) of the wire formative and results in the anchor 240 having compressive/tensile strength of 140% of the original wire formative material. Optionally, the minor axis 265 of the compressively reduced loop 258 is fabricated from either 0.250-inch diameter wire (resulting in the anchor 240 having compressive/tensile strength rating at least 200% greater than the rating for a non-reduced wire) or 0.187-inch diameter wire (resulting in the anchor 240 having compressive/tensile strength rating at least 100% greater than the rating for a non-reduced wire). The ribbon loop 258, once compressed, is ribbon-like in appearance; however, maintains substantially the same cross sectional area as the wire formative body. The ribbon loop 258 is formed from the attachment ends 254. Optionally, for ease of manufacture, the attachment end 254 is similarly compressively reduced as shown in FIG. 11.

A veneer tie 244 is interconnected with the anchor 240 for embedment in bed joint 230. The veneer tie or anchor 244 is, when viewed from a top or bottom elevation, generally rectangular in shape and is a basically planar body. The veneer anchor 244 is dimensioned to be accommodated by the ribbon loop 258 The veneer tie 244 has an interengaging end portion 262 for disposition in the ribbon loop 258 and an insertion end portion 268 for disposition in the bed joint 230 of the facing wall 218.

The box-shaped veneer anchor 244 is optimally a box tie similar to that of the Byna-Lok® of Hohmann & Barnard. The ribbon loops 258 of the wall anchor 240 is constructed so that with insertion of the veneer tie 244 through eyelet 261, the misalignment between bed joints tolerated is approximately one-half the vertical spacing between adjacent bed joints of the facing brick course. As described in the embodiments below, the veneer tie 244 is optionally compressed to form a low profile veneer tie 244, as shown in FIG. 5. Upon compression, a pattern or corrugation 176 is impressed. Alternatively, the veneer tie 244 is swaged 276 to accommodate a reinforcement wire 271, as shown in FIG. 9, to form a seismic structure.

Analytically, the circular cross-section of a wire provides greater flexural strength than a sheet metal counterpart. In the embodiments described herein the ribbon loops 58, 158, 258 and other compressed components of the anchors 40, 140, 240 are cold-worked or partially flattened so that the specification is maintained and high-strength ribbon loops are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. In each example in FIG. 12, progressive deformation of a wire is shown. Disregarding elongation and noting the prior comments, the topmost portion shows the original wire having a radius, $r_1=1$; and area, $A_1=\Pi$; length of deformation, $L=0$; and a diameter, $D_1$. Upon successive deformations, the illustrations shows the area of circular cross-section bring progressively ½, ⅜ and ¼ of the area, $A_1$, or $A_2=\frac{1}{2}\Pi$; $A_3=\frac{3}{8}\Pi$; and $A_4=\frac{1}{4}\Pi$, respectively. With the first deformation, the rectangular portion has a length L=1.11r (in terms of the initial radius of 1); a height, $h_2$=1.14; ($D_2$=0.71$D_1$, where D=diameter); and therefore has an area of approximately ½Π. Likewise, with the second deformation, the rectangular portion has a length, L=1.38r; a height, $h_3$=1.14; a diameter $D_3$=0.57$D_1$; and therefore has an area of approximately ⅝Π. Yet again, with the third deformation, the rectangular portion has a length, L=2.36r; a height $h_4$=1; a diameter, degree of plastic deformation to remain at a 0.300 inch (approx.) combined height for the truss and wall tie can, as will be seen hereinbelow, be used to optimize the high-span ribbon pintle anchoring system.

In testing the high-strength ribbon loop described hereinabove, the test protocol is drawing from ASTM Standard E754-80 (Reapproved 2006) entitled, *Standard Test Method for Pullout Resistance of Ties and Anchors Embedded in Masonry Mortar Joints*. This test method is under the jurisdiction of ASTM Committee E06 on Performance of Buildings.

In forming the ribbon loops 58, 158, 258, the wire body of up to 0.375-inch in diameter is compressed up to 75% of the wire diameter. When compared to standard wire formatives having diameters in the 0.172- to 0.195-inch range, a ribbon loop 58, 158, 258 is reduced by one-third from the same stock as the standard wire formatives showed upon testing a tension and compression rating that was at least 130% of the rating for the standard wire formative.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An anchoring system for use in a wall having a backup wall and a facing wall in a spaced apart relationship forming a cavity therebetween, the backup wall formed from a plurality of successive courses of masonry blocks with a bed joint between each two adjacent courses, the anchoring system comprising:

a wire formative wall reinforcement for insertion in the bed joint and having attachment sites at intervals therealong, the attachment sites each comprising an indentation swaged into the wire formative wall reinforcement;

at least one wall anchor connected to the wire formative wall reinforcement, the at least one wall anchor comprising a wire formative having a diameter and having at least two attachment portions connected to the attachment sites, the at least one wall anchor further comprising a ribbon loop portion contiguous with the at least two attachment portions for disposition in the cavity, the ribbon loop portion being compressively reduced.

2. The anchoring system as set forth in claim 1 wherein an interconnection of each attachment portion of the at least one wall anchor in the indentation forming the attachment site defines a juncture, the juncture having an overall height not greater than the diameter of the wire formative of the at least one wall anchor.

3. The anchoring system as set forth in claim 1 further comprising a veneer tie having an interengaging end portion for interengagement with the ribbon loop portion and, upon installation, configured for insertion in the facing wall.

4. The anchoring system according to claim 3, wherein the ribbon loop portion is fabricated from a wire having a diameter of up to 0.375-inch and when compressively reduced in thickness up to 75% of the original diameter thereof has a tension and compression rating of at least 130% of the rating for a non-reduced wire formative.

5. The anchoring system according to claim 4, wherein the ribbon loop portion further comprises an eyelet vertically disposed in the cavity and welded closed forming an oval opening therethrough with a predetermined diameter in a functional relationship with the diameter of the veneer tie interengaging end portion.

6. The anchoring system according to claim 5, and wherein a major cross-sectional axis of the ribbon loop portion is generally parallel to the wire formative wall reinforcement.

7. The anchoring system according to claim 6, wherein the facing wall is formed from a plurality of successive courses of bricks with a bed joint between adjacent courses; and wherein, the veneer tie is a box tie having an opening for threadingly engaging the ribbon loop portion, the opening configured for insertion in the bed joint of the facing wall.

8. An anchoring system for use in a wall having a backup wall and a facing wall in a spaced apart relationship forming a cavity therebetween, the backup wall formed from a plurality of successive courses of masonry blocks with a bed joint between each two adjacent courses, the anchoring system comprising:

a wire formative wall reinforcement for insertion in the bed joint and having attachment sites at intervals therealong, the attachment sites each comprising an indentation swaged into the wire formative wall reinforcement;

at least one wall anchor connected to the wire formative wall reinforcement, the at least one wall anchor comprising a wire formative having a diameter and having at least two attachment portions connected to the attachment sites, and leg portions extending toward the cavity, an interconnection of each of the at least two attachment portions of the at least one wall anchor in the indentation forming the attachment site defines a juncture, the juncture having an overall height not greater than the diameter of the wire formative of the wall anchor, the at least one wall anchor further comprising a ribbon loop portion contiguous with the at least two attachment portions for disposition in the cavity, the ribbon loop portion having a thickness and a width, the width being greater than the thickness, and wherein the width is generally parallel to the leg portions of the at least one wall anchor.

9. The anchoring system as set forth in claim 8 further comprising a veneer tie configured for connection to the wall anchor and, upon installation, configured for insertion in the facing wall.

10. An anchoring system for use in a wall having a backup wall and a facing wall in a spaced apart relationship forming a cavity therebetween, the backup wall formed from a plurality of successive courses of masonry blocks with a bed joint between each two adjacent courses, the anchoring system comprising:

a wire formative wall reinforcement for insertion in the bed joint and having attachment sites at intervals therealong;

at least one wall anchor connected to the wire formative wall reinforcement, the at least one wall anchor comprising a wire formative having a diameter and having at least two attachment portions connected to the attachment sites, the at least one wall anchor further comprising a ribbon loop portion contiguous with the at least two attachment portions for disposition in the cavity, the ribbon loop portion being compressively reduced.

11. The anchoring system according to claim 10, wherein the ribbon loop portion is fabricated from a wire having a diameter of up to 0.375-inch and when compressively reduced in thickness up to 75% of the original diameter thereof has a tension and compression rating of at least 130% of the rating for a non-reduced wire formative.

12. The anchoring system according to claim 10, further comprising a veneer tie adapted for connection to the wall anchor, and wherein the ribbon loop portion further comprises an eyelet vertically disposed in the cavity and welded closed forming an oval opening therethrough with a predetermined diameter in a functional relationship with the diameter of the veneer tie interengaging end portion.

13. The anchoring system according to claim 12, and wherein a major cross-sectional axis of the ribbon loop portion is generally parallel to the wire formative wall reinforcement.

14. The anchoring system according to claim 13, wherein the facing wall is formed from a plurality of successive courses of bricks with a bed joint between adjacent courses; and wherein, the veneer tie is a box tie having an opening for threadingly engaging the ribbon loop portion, the opening configured for insertion in the bed joint of the facing wall.

* * * * *